US005618584A

United States Patent [19]

Schaede

[11] Patent Number: 5,618,584

[45] Date of Patent: Apr. 8, 1997

[54] METHOD AND APPARATUS FOR DAMPING A PAPER WEB

[75] Inventor: Johannes G. Schaede, Würzburg, Germany

[73] Assignee: Koenig & Bauer-Albert Aktiengesellschaft, Wurzburg, Germany

[21] Appl. No.: 542,740

[22] Filed: Oct. 13, 1995

[30] Foreign Application Priority Data

Oct. 13, 1994 [DE] Germany ..... 44 36 627.2

[51] Int. Cl.[6] ..... B05D 3/04; B05D 3/10

[52] U.S. Cl. ..... 427/336; 101/424.1; 118/50; 118/58; 427/350

[58] Field of Search ..... 427/296, 336, 427/350; 101/424.1; 118/50, 58

[56] References Cited

U.S. PATENT DOCUMENTS

| | | | |
|---|---|---|---|
| 4,265,941 | 5/1981 | Saito | 427/296 |
| 4,841,903 | 6/1989 | Bird | 427/258 X |
| 5,445,671 | 8/1995 | Herget et al. | 406/20 R |
| 5,447,753 | 9/1995 | Noda et al. | 427/296 |

FOREIGN PATENT DOCUMENTS

| | | |
|---|---|---|
| 299681 | 8/1969 | Austria . |
| 0154251 | 9/1985 | European Pat. Off. . |
| 0364425 | 4/1990 | European Pat. Off. . |
| 164014 | 7/1904 | Germany . |
| 603056 | 2/1933 | Germany . |
| 1005826 | 4/1957 | Germany . |
| 2759666 | 6/1986 | Germany . |
| 4227136 | 2/1994 | Germany . |

*Primary Examiner*—Michael Lusignan
*Attorney, Agent, or Firm*—Jones, Tullar & Cooper, P.C.

[57] ABSTRACT

Damping fluid is applied to a surface of a paper web and is caused to be transported into the web by a gas pressure gradient. The surface of the paper web bearing the damping fluid is subjected to a higher pressure over a large area. The gas pressure gradient can be changed or controlled to vary the rate of damping solution absorption into the paper web.

6 Claims, 3 Drawing Sheets

METHOD AND APPARATUS FOR DAMPING A PAPER WEB

FIELD OF THE INVENTION

The present invention is directed generally to a method and apparatus for damping a paper web. More particularly, the present invention is directed to a method and apparatus for damping a printed and thermally dried paper web. Most specifically, the present invention is directed to a method and apparatus for damping a paper web using a damping solution that is transported into the paper web by a pressure gradient. The damping solution is applied to an upper, printed side of a paper web that has been thermally dried. A gas pressure gradient is established between the upper surface of the paper web, to which the damping solution has been applied, and the bottom surface of the web. This gas pressure gradient facilitates the transport of the damping solution into the paper web over a large area without generating undue stress in any one area of the web.

DESCRIPTION OF THE PRIOR ART

In the treatment and processing of paper webs, such as in the printing and subsequent drying of the printed web, it is often necessary to apply a damping solution to the web surface. This damping solution can be applied by the use of rollers, sprays, brushes and the like. The damping solution is applied to the paper web typically after one web treating or processing step has been accomplished and before another step is to begin. The application of a damping solution to a paper web is particularly necessary when the web is being printed and then subjected to a thermal drying step.

In the German patent application DE 42 27 136 A1, there is disclosed a process and a device for use in the damping of a printed and subsequently thermally dried paper web. In this process, the printed material is damped with a damping solution after the material has been dried. In this device, the damping material is applied to the printed material by utilization of a damping application roller.

One limitation of this prior art process and apparatus for the application of a damping solution to the paper web is the application of a localized high stress to the web. The damping fluid is applied to the paper web by engagement of the web with a roller. A relatively high pressure is exerted by the roller against the web. This high pressure is applied over a very limited area of the paper web due to the essentially line contact nature of the engagement of the roller with the web. This high pressure is apt to lead to deformation of the printed material. Such deformation can alter web register and can possibly cause permanent damage to the web.

It will be seen that a need exists for a process and a device for damping a paper web which overcomes these limitations of the prior art. The method and apparatus for paper web damping in accordance with the present invention provides such a method and apparatus and is a significant improvement over the prior art.

SUMMARY OF THE INVENTION

It is an object of the present invention to provide a method and an apparatus for damping a paper web.

Another object of the present invention is to provide a method and apparatus for damping a printed and thermally dried paper web.

A further object of the present invention is to provide a method and apparatus for damping a paper web using a damping fluid transported through the paper web by a gas pressure gradient.

Still another object of the present invention is to provide a method and apparatus for damping a paper web using a gas pressure gradient over a large web area.

Yet a further object of the present invention is to provide a method and apparatus for damping a paper web using a vacuum induced pressure differential.

Even still another object of the present invention is to provide a method and apparatus for damping a paper web uniformly and at low tension without the need for press-on rollers and without creating high web tension.

As will be discussed in detail in the description of the preferred embodiment which is presented subsequently, the method and apparatus for damping a paper web in accordance with the present invention uses a gas pressure gradient to transport the damping solution into the paper web which is being damped. The paper web has damping fluid or solution applied to one surface and the web is then subjected to a gas pressure gradient over a wide surface area. The gas pressure gradient can be created by a positive pressure acting on the damped side of the web and directed against the web surface, or by a negative pressure or vacuum that is applied to the web surface opposite to that to which the damping fluid has been applied. In either instance, the damping fluid is transported more thoroughly by use of the gas pressure gradient.

A primary advantage of the present invention is the creation of a damping fluid transport force which is effective yet which avoids the creation of a high pressure, low area force. The gas pressure gradient creates a large area, low surface pressure force that prevents overstressing or deformation of the paper web. Another advantage of the present invention is the large amount of time during which the gas pressure gradient is applied to any given area of the paper web. Although the paper web is moving during this damping process, the use of a large area to apply the damping transport force has the effect of creating a longer time in which the damping fluid can enter the paper web. This results in the intensification of the diffusion process of the damping fluid into the deeper fiber layers of the paper web. The diffusion process is very much time dependent so by increasing the time during which the gas pressure gradient can act on a web surface, the better the diffusion of the damping fluid into the paper web will be.

The damping fluid process and apparatus in accordance with the present invention results in a very careful and thorough damping of the paper web. The present invention overcomes the limitations of the prior art and is a substantial advance in the art.

BRIEF DESCRIPTION OF THE DRAWINGS

While the novel features of the method and apparatus for damping a paper web in accordance with the present invention are set forth with particularity in the appended claims, a full and complete understanding of the invention may be had by referring to the detailed description of the preferred embodiment which is presented subsequently, and as illustrated in the accompanying drawings, in which:

DETAILED DESCRIPTION OF THE PREFERRED EMBODIMENTS

Figure 1:
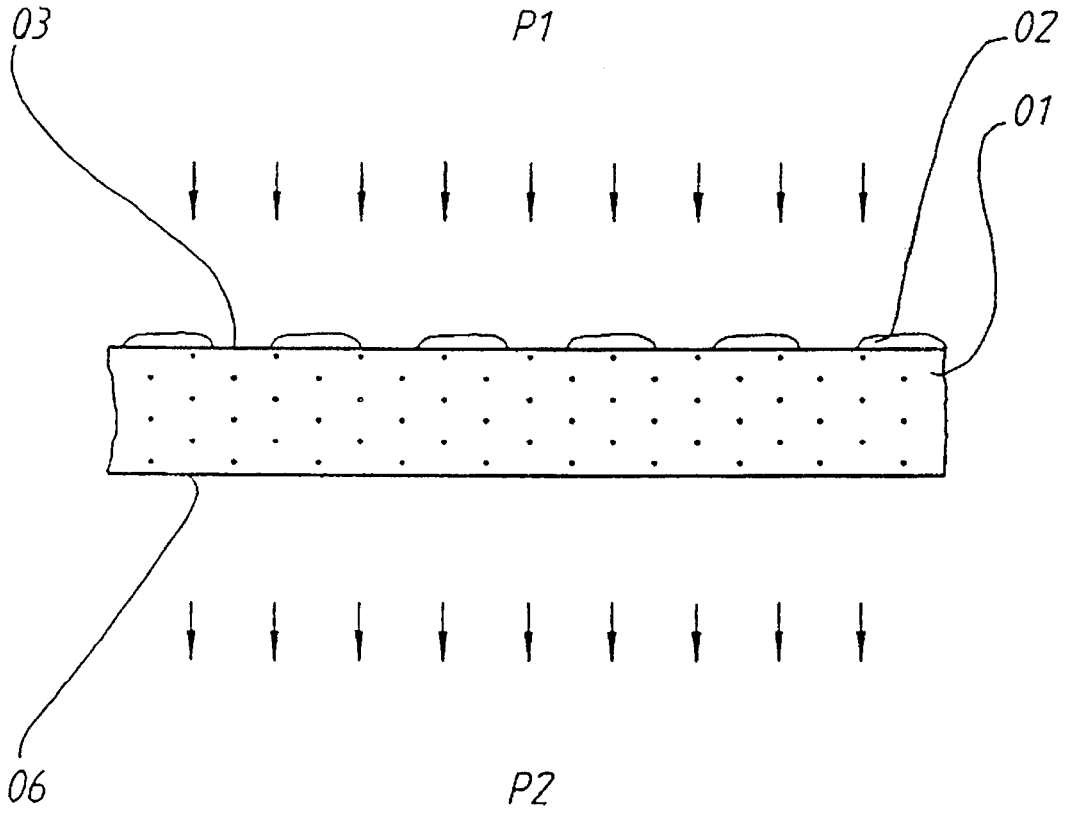
FIG. 1 is a schematic side elevation view of a portion of a paper web and illustrating the method of damping in accordance with the present invention.

Referring initially to FIG. 1, there may be seen a schematic depiction of a method or a process for damping a printed paper web 1 in accordance with the present invention. It will be understood that the paper web 1 depicted in FIG. 1 as well as in FIGS. 2 and 3, which will be discussed shortly, is one that has been printed and that has been sent through a thermally acting dryer section, which is not specifically shown in the drawings. In such a dryer, a stream of hot air is directed against an upper or first surface 3 of the paper web 1 so that the volatile solvents in the ink applied to the web 1 will be evaporated to thereby dry the ink on the paper web 1. In the process of applying heated air against the surface 3 of the web 1, the moisture content of the paper web 1 is also substantially reduced. The low water or steam partial pressure or low relative humidity of the air in the thermal dryer section of the printing press also is responsible for the loss of paper web moisture. As the humidity or moisture is withdrawn from the paper web, it becomes more brittle and it also shrinks. After the paper web 1 has passed through the thermal drier sections, its humidity or moisture content is only about 2–4 weight percent. This low moisture content, and its resultant paper web brittleness and dimensional deviations caused by the shrinkage of the web, make the web difficult to handle and creates register errors.

Figure 2:
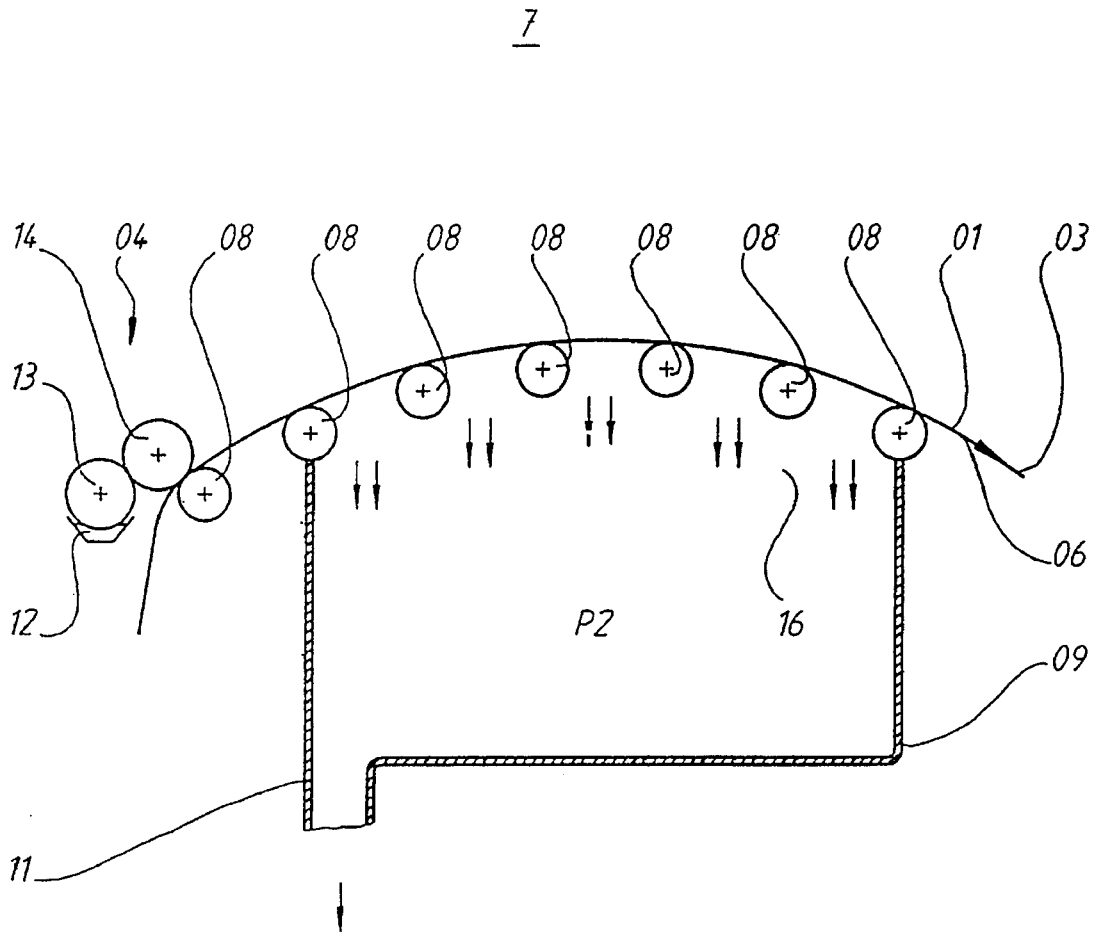
FIG. 2 is a schematic side elevation view of a first preferred embodiment of an apparatus for damping a paper web in accordance with the present invention.
Figure 3:
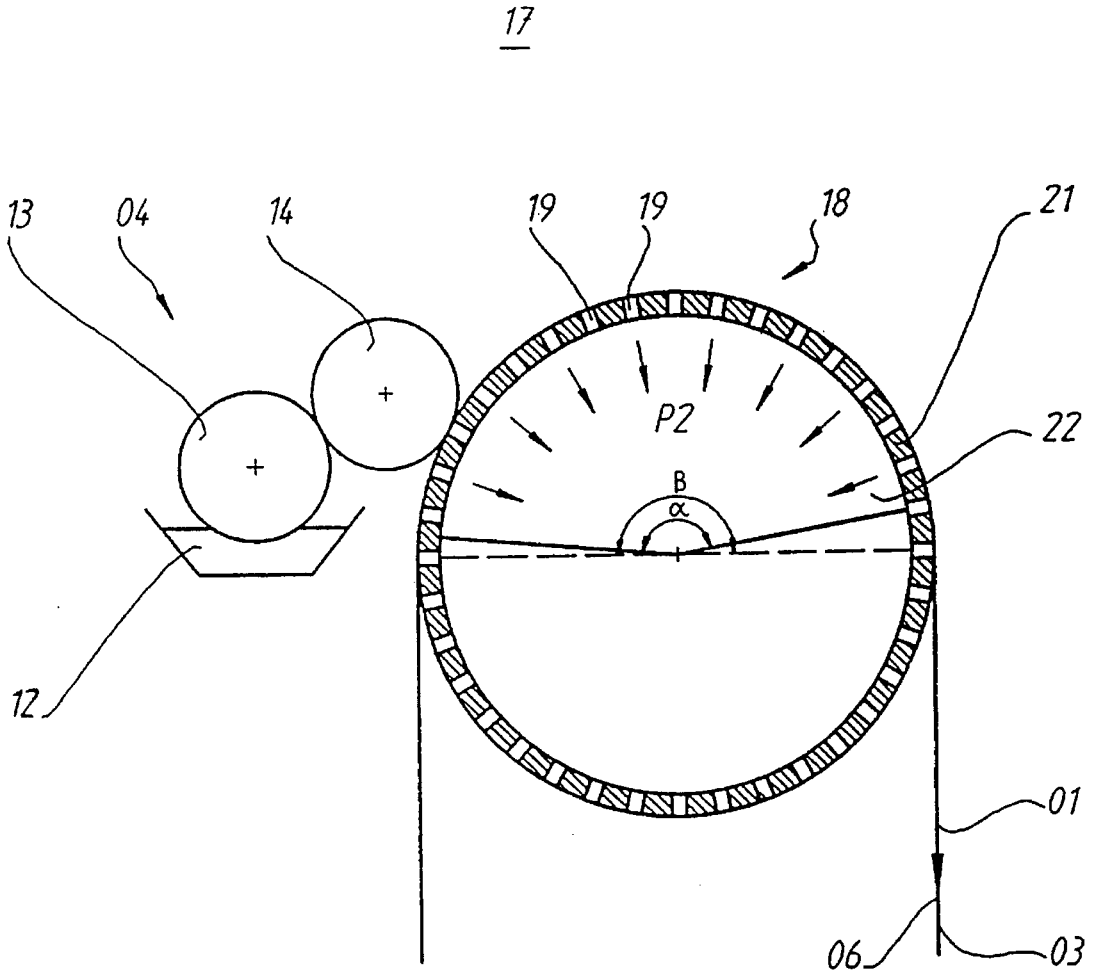
FIG. 3 is a schematic side elevation view of a second preferred embodiment of a damping apparatus.

In order to condition the paper web 1 for further processing, such as additional printing, folding, cutting or binding, it is necessary to apply a suitable damping solution, schematically depicted at 2 in FIG. 1, to the upper surface 3 of the paper web 1. The addition of this damping solution restores the appropriate moisture to the paper web so that it can be further processed, as discussed above, without being damaged. In accordance with the present invention, the damping solution is caused to move into the paper web 1 by creation of a gas pressure gradient across the paper web. As may be seen in FIG. 1, a first gas pressure P1 is maintained in the area adjacent the first or upper surface 3 of the paper web 1. A second gas pressure P2 is maintained in the area adjacent the second or bottom surface 6 of the paper web 1. The two pressures P1 and P2 will be different and will create a gas pressure differential or delta P with the higher gas pressure being applied on the side of the paper web 1 to which the damping solution 2 is applied. The damping solution 2 is applied to the high pressure side of the paper web 1 by a suitable damping unit 4, as depicted in FIGS. 2 and 3. This damping solution could be water or could be water with additives, such as, for example, tensides. The damping unit 4 could be a spray unit, a brushing unit, a continuous-feed damping system or other suitable damping solution applicator. The gas pressure differential or delta P created by the difference in pressure between the high pressure P1 and the low pressure P2 will drive or transport the damping solution 2 through the paper web 1 in the direction from high pressure to low pressure.

In one method of generating the gas pressure differential or gradient, as schematically depicted in FIG. 1, an overpressure P1 can be generated by blowing air in the direction indicated by the arrows in FIG. 1; i.e. toward the upper or first surface 3 of the paper web 1. Alternatively, a vacuum can be created in the area of the paper web bottom surface 6, which is the area not treated with damping fluid 2, while leaving the damped surface 3 exposed to atmospheric air. A combination of both overpressure at P1 and underpressure at P2 can also be used to create the pressure gradient delta P which will have the effect of causing or facilitating the diffusion of the damping solution 2 into the paper web 1 over a large area of the web 1. As discussed above, this diffusion of damping fluid 2 into paper web 1 increases the moisture content of the paper web 1.

The quantity of the damping solution 2 that will permeate into the paper web 1 is a function of the permeability of the paper web, the amount of the effective gas pressure gradient, delta P, and the time the gas pressure gradient is acting on the paper web 1. This time is, in turn, a function of the area of the paper web 1 which is being subjected to the gas pressure gradient at any time interval and the speed of the paper web through the treating or pressure gradient zone. The humidity or moisture content of the paper web exiting the treatment area can be controlled by the size of the gas pressure gradient that is selected.

Turning now to FIG. 2, there may be seen, in somewhat schematic form, a first preferred embodiment of a paper web damping apparatus, generally at 7, in accordance with the present invention. In this damping apparatus, the paper web 1 is first dampened by use of a damping assembly, generally at 4, and then passes over a plurality of supporting elements in the form of guide or idler rollers 8. The guide or idler rollers 8 form an open top for a generally closed suction box 9. The side walls and the bottom wall of the suction box 9 are closed. A vacuum connection 11 is provided in the suction box 9 and is connectable to an appropriate vacuum source which is not specifically shown. The damping unit 4 consists of a damping solution container 12, a damping duct roller 13 and a damping roller 14. The damping duct roller 13 is immersed into the damping solution 2 in the damping solution container 12 and supplies the damping solution 2 to the damping roller 14 which, in turn, applies the solution 2 to the first or upper surface 3 of the paper web 1. The paper web 1, with its application of damping fluid 2 is caused to move over the idler rollers 8 while a vacuum is applied to the interior of the suction box 9. This creates the appropriate gas pressure gradient between the atmosphere exterior of the box 9 and acting on the top surface 3 of the paper web 1, and the bottom surface 6 of the web 1 which is exposed to the vacuum in the interior of the suction box 9. The vacuum-generated force 16 acts on a large area of the paper web 1 since the idler rollers 8 have an axial length that is as long as the width of the paper web 1. This vacuum-generated force 16 or gas pressure gradient acts to transport the damping solution 2 through the paper web 1 from the high pressure side 3 to the low pressure side 6. If better or more secure support of the paper web 1 were to be required, the various idler rollers 8 could be augmented by placing a plurality of apertured bands, which are not specifically shown in the drawing, over the rollers 8.

Turning now to FIG. 3, there may be seen a second preferred embodiment of a device for damping a paper web in accordance with the present invention. In this second embodiment, which is depicted generally at 17, the paper web 1 is provided with damping fluid 2 on a first side 3 by use of a damping unit 4 which is the same as the one discussed previously in connection with FIG. 2. The dampened paper web 1 then is conducted over a suction roller 18. As may be seen in FIG. 3, the suction roller 18 has a rotatable shell that rotates about a central axis of rotation.

The shell is an absorbing or air permeable material, such as ceramic, or can be provided with a plurality of radially directed bores 19, or both. A stationary suction chamber 22 is defined within the rotatable shell 21 by the use of suitable radially directed, axially extending walls. The vacuum or suction chamber 22 ha a suitable connection, not shown, to an appropriate vacuum source and has a length in the axial direction of the rotatable cylinder shell 21 which is at least equal to the width of the paper web 1. The stationary suction chamber 22 defines a vacuum zone in the rotatable shell 21 that has a suction chamber angle α of generally about 160°. The paper web 1 wraps about the outer surface of the rotatable shell 21 with a wrap angle β which, as may be seen in FIG. 3 is equal to or greater than the suction chamber angle α. This insures that the periphery of the rotatable shell 21 which is aligned with the stationary suction chamber 22 will be overlaid by the dampened paper web 1. In this second preferred embodiment 17 the gas pressure gradient P2 acts from the outer surface 3 of the paper web 1 toward the inner surface 6 of the paper web 1 to transport the damping solution 2 into the paper web 1.

While preferred embodiments of a method and apparatus for damping a paper web in accordance with the present invention have been set forth fully and completely hereinabove, it will be apparent to one of skill in the art that a number of changes in, for example, vacuum supply source, the support assemblies for the various cylinders and rollers, the web transport devices and the like could be made without departing from the true spirit and scope of the present invention which is accordingly to be limited only by the following claims.

What is claimed is:

1. A method for damping a printed and subsequently thermally dried paper web including the steps of:

providing a damping solution;

applying said damping solution to a first side of a paper web;

providing a first gas pressure on said first side of said paper web;

providing a second gas pressure, lower than said first gas pressure on a second side of said paper web;

forming a gas pressure gradient across a web area of said paper web using said first and said second gas pressures; and using said gas pressure gradient to transport said damping solution into said paper web.

2. The method of claim 1 further including providing said second gas pressure as a vacuum acting across said wide area of said paper web.

3. The method of claim 1 further including providing said first gas pressure as a positive pressure.

4. The method of claim 2 further including providing said first gas pressure as a positive pressure.

5. The method of claim 2 further including providing said second gas pressure as a vacuum.

6. The method of claim 1 further including providing said gas pressure gradient as being adjustable.

* * * * *